US008408672B2

(12) United States Patent
Cramm et al.

(10) Patent No.: US 8,408,672 B2
(45) Date of Patent: Apr. 2, 2013

(54) MAINTENANCE UNIT FOR PRINT HEAD

(75) Inventors: Georg Cramm, Basel (CH); Axel Heinrich, Aschaffenburg (DE); Stephan Pirl, Obernburg (DE); Gabriela Cocora, Elsenfeld-Eichelsbach (DE)

(73) Assignee: Novartis AG, Basel (CH)

( * ) Notice: Subject to any disclaimer, the term of this patent is extended or adjusted under 35 U.S.C. 154(b) by 315 days.

(21) Appl. No.: 12/791,935

(22) Filed: Jun. 2, 2010

(65) Prior Publication Data

US 2010/0309251 A1 Dec. 9, 2010

(30) Foreign Application Priority Data

Jun. 3, 2009 (EP) ..... 09161793

(51) Int. Cl.
*B41J 2/165* (2006.01)

(52) U.S. Cl. ..... 347/22; 347/33; 347/28; 347/34

(58) Field of Classification Search ..... 347/33, 347/28, 22, 34
See application file for complete search history.

(56) References Cited

U.S. PATENT DOCUMENTS

| | | | | |
|---|---|---|---|---|
| 4,933,015 | A * | 6/1990 | White | 134/6 |
| 5,239,316 | A * | 8/1993 | Demarchi et al. | 347/33 |
| 5,793,390 | A | 8/1998 | Claflin | |
| 6,281,909 | B1 | 8/2001 | Fassler | |
| 6,336,699 | B1 * | 1/2002 | Sarkissian et al. | 347/33 |
| 6,460,967 | B1 * | 10/2002 | Makita et al. | 347/33 |
| 6,592,201 | B2 | 7/2003 | Sharma | |
| 7,083,252 | B2 | 8/2006 | Yokoyama | |
| 7,172,262 | B2 | 2/2007 | Sugimura | |
| 7,411,008 | B2 | 8/2008 | Tucker | |
| 7,723,402 | B2 | 5/2010 | Tucker | |
| 2002/0140762 | A1 | 10/2002 | Sharma | |
| 2003/0119943 | A1 | 6/2003 | Tucker | |
| 2004/0223028 | A1 | 11/2004 | Yokoyama | |
| 2005/0001873 | A1 | 1/2005 | Sugimura | |
| 2007/0117884 | A1 | 5/2007 | Tucker | |
| 2008/0192089 | A1 | 8/2008 | Albertalli | |
| 2010/0174009 | A1 | 7/2010 | Tucker | |

FOREIGN PATENT DOCUMENTS

| | | | |
|---|---|---|---|
| EP | 0621136 | A2 | 10/1994 |
| EP | 0945270 | A2 | 9/1999 |
| EP | 0988978 | A1 | 3/2000 |
| EP | 1468834 | A1 | 10/2004 |
| JP | 54119238 | A | 9/1979 |
| WO | 03040242 | A2 | 5/2003 |
| WO | 2006116415 | A2 | 11/2006 |

OTHER PUBLICATIONS

European Search Report dated Nov. 30, 2009 for European Application No. 09161793.6.

(Continued)

*Primary Examiner* — Matthew Luu
*Assistant Examiner* — Henok Legesse
(74) *Attorney, Agent, or Firm* — Sheng-Hsin Hu

(57) ABSTRACT

The present invention generally relates to a printing apparatus including one or more print heads for depositing printing fluid onto a substrate, wherein the apparatus comprises a maintenance unit for the one or more print heads. The present invention further relates to a method for cleaning one or more print heads from adhering printing fluid. The present invention also relates to the use of said apparatus in the automated manufacture of a contact lens, in particular a silicone hydrogel contact lens.

13 Claims, 3 Drawing Sheets

OTHER PUBLICATIONS

PCT International Search Report dated Aug. 11, 2010 for International Application No. PCT/EP2010/057683, International Filing Date Jun. 2, 2010.

PCT Written Opinion of the International Searching Authority dated Aug. 11, 2010 for International Application No. PCT/EP2010/057683, International Filing Date Jun. 2, 2010.

* cited by examiner

MAINTENANCE UNIT FOR PRINT HEAD

This application claims foreign priority under 35 U.S.C. §119 of European Patent Application No. 09161793.6 filed Jun. 3, 2009, incorporated by reference in its entirety.

The present invention generally relates to a printing apparatus including one or more print heads for depositing printing fluid onto a substrate, wherein the apparatus comprises a maintenance unit for the one or more print heads. The present invention further relates to a method for cleaning one or more print heads from adhering printing fluid. The present invention also relates to the use of said apparatus in the automated manufacture of a contact lens, in particular a silicone hydrogel contact lens.

BACKGROUND OF THE INVENTION

Ophthalmic lenses, in particular contact lenses, which it is intended to produce economically in large numbers, are preferably produced by the so-called mold or full-mold process. In order to produce a contact lens, usually a specific amount of a flowable lens forming material is introduced into the female mold half in a first step. The mold is then closed by putting the male mold half into place. The subsequent polymerization and/or cross-linking of the lens forming material is carried out by means of irradiation with UV light and/or by heating. After the lens if formed, the mold is disassembled and the lens removed. Additional processing steps, such as inspection, extraction, hydration, surface treatment and sterilization may finally be performed on the lens before packaging.

For cosmetic purposes, contact lenses having one or more colorants printed on the lens or onto the molds that are then used to make the contact lenses are in high demand. These colored contact lenses may enhance the natural beauty of the eye and/or may provide unique patterns on the iris of the wearer. Further, non cosmetic patterns or marks, such as rotation marks, inversion marks, product codes and/or lot numbers may be printed onto the contact lenses or onto the molds that are then used to make the contact lenses. Said non cosmetic patterns or marks are of particular benefits to wearers, eye-care practitioners and manufacturers.

Various methods have been disclosed for printing either directly onto the contact lenses or onto the molds that are then used to make the contact lenses.

A printing fluid, i.e. an ink, can be applied to a contact lens or to a mold according to known printing technologies, such as, for example ink jet printing.

Typical inks for ink jet applications, have one or more of the following characteristics: a viscosity lower than 50 m Pa·s, preferably lower than 15 m Pa·s; most preferably below 15 m Pa·s; a surface tension of from 20 mN/m to 60 mN/m; a particle size of less than 5 μm, preferably lower than 1 μm; most preferably below 0.5 μm; prolonged stability (i.e., stable for at least 4 hours, preferably at least 8 hours, more preferably at least 24 hours); an appropriate color level (visible by eye); uniform drop formation and jet stability; good adhesion to contact lenses; good transfer from a mold to a contact lens made in the mold.

A common problem in ink jet printing is the clogging of the nozzles in the print head due to bubbles or contaminants in the ink channels or due to increase in ink viscosity.

WO-A-2006/116415 discloses a print head maintenance station for an industrial printing apparatus which is used to prevent clogging of the print head, particularly during periods in which the print head is idle. The maintenance station includes a capping station which has sockets for keeping the print head moist, and a blotting station for cleaning any residual printing fluids prior to carrying out a print function.

In the manufacture of contact lenses, which are intended to be produced economically in large numbers, fast drying inks and/or UV curable inks are used, as for example described in WO-A-2003/040242. In particular with said fast drying and/or UV curable inks, fully or partly cured and/or fully or partly dried ink adhering to the ink nozzles can lead to persistent clogging of the same.

It has now been found, that conventional maintenance stations, as for example described in WO-A-2006/116415, are not suitable for fast drying inks and/or UV curable inks as used in the manufacture of contact lenses, in particular in the manufacture of silicone hydrogel contact lenses, which are provided with a printed image thereon.

Accordingly, it is an object of the present invention to provide an improved apparatus for cleaning a print head, in particular an ink jet print head, from adhered ink which is fully or partly cured and/or fully or partly dried.

It is a further object of the present invention to provide an improved apparatus for maintaining a print head, in particular an ink jet print head, sufficiently wet during periods in which the print head is idle.

It is still a further object of the present invention to provide an apparatus useful for the manufacture of a contact lens, in particular a silicone hydrogel contact lens, which is provided with a printed image thereon.

SUMMARY OF THE INVENTION

These objects are achieved by an apparatus and method according to the respective independent claims. Further embodiments of the apparatus and method according to the invention are defined in the respective dependent claims.

DEFINITIONS

Figure 1:
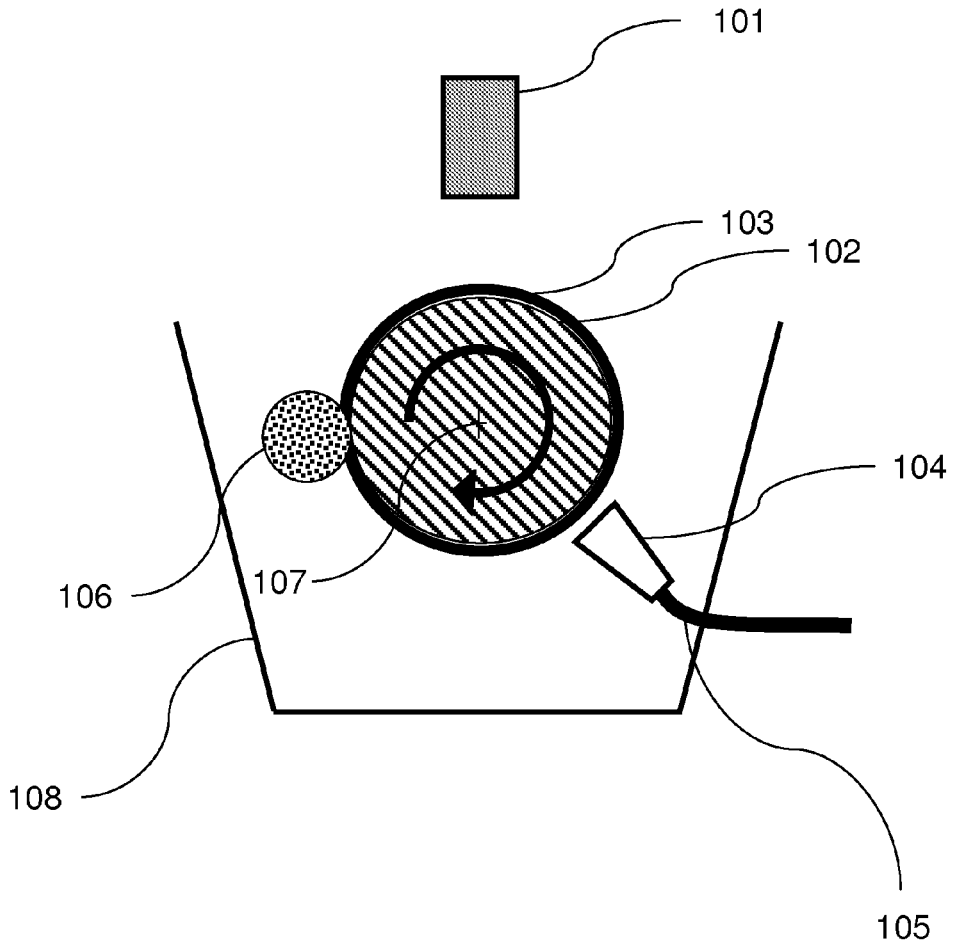
FIG. 1 is a schematic representation of an embodiment of a maintenance unit according to the present invention.

A fast drying ink is an ink with a so called "open time", of less than 30 seconds, preferably of less than 10 seconds, and more preferably of less than 5 seconds.

A UV curable ink is an ink which is curable under irradiation of UV light, wherein the wavelength of the UV light is depending on the photo initiator used in the ink composition. For example UV light with a wavelength of 300 nm may be used for an ink composition comprising Irgacure® 2959 as the photo initiator. Other suitable photo initiators are benzoin methyl ether, diethoxyacetophenone, a benzoylphosphine oxide, 1-hydroxycyclohexyl phenyl ketone and Darocure type initiators, such as Darocur® 1173.

A drum generally is an elongated cylindrical body, which has a rotation axis at the center.

A drum according to the present invention preferably is made of metal (e.g. aluminum) or a plastic material (e.g. polyamide).

A covering is a compressible material affixed to the surface of the drum, which preferably is made of a suture-less, lint free material, most preferably a close-mesh woven synthetic tissue or a foam.

A dry covering is a covering which does not contain any cleaning liquid at all or which only contains an amount of cleaning liquid below a specific threshold. In particular a dry covering does not contain sufficient cleaning liquid to dissolve dried and/or cured ink residues at the nozzle plate of the print head.

A damp covering is a covering which contains a sufficient amount of cleaning liquid to dissolve dried and/or cured ink residues at the nozzle plate, but not as much as to allow the cleaning liquid to enter into the cavities of the print head.

A wet covering is a covering which contains an amount of cleaning liquid above a specific threshold. In particular a wet covering does contain an amount of cleaning liquid which allows to form droplets of cleaning liquid on the surface plate of the print head and/or which allows the cleaning liquid to enter into the cavities of the print head.

A roller generally is an elongated cylindrical body, which has a rotation axis at the center. Preferably the diameter of the roller is smaller than the diameter of the drum and rotates passively with the actuated rotation of the drum. A roller according to the present invention preferably is made of metal (e.g. aluminum) or a plastic material (e.g. polyamide).

A nozzle generally is a projecting spout from which a fluid (i.e. the cleaning liquid) is discharged.

A cleaning liquid in the context of the present invention can be water (which additionally may comprise a surfactant) or a suitable organic solvent. A preferred cleaning liquid is water.

An ink jet ink for printing an image on a contact lens or a mold to then form said contact lens, typically comprises a colorant, a solvent, and a binder polymer.

A "colorant" means either a dye or a pigment or a mixture thereof.

A "solvent" can be water or any appropriate organic or inorganic solvent. Any known suitable solvents can be used, so long as they can dissolve the binder in the ink of the invention and aid in the stability of the colorant. Exemplary solvents include, without limitation, water, acetone, alcohols (e.g., methanol, ethanol, propanol, isopropanol, etc.), glycols, ketones, esters, cyclopentanone, cyclohexanone, tetrahydrofuran, acetone, methyl-2-pyrrolidone, dimethyl formamide, acetophenone, methylene dichloride, dimethyl sulfoxide, gamma-butyrolactone, ethylene dichloride, isophorone, o-dichlorobenzene, tetrahydrofuran, diacetone alcohol, methyl ethyl ketone, acetone, 2-nitropropane, ethylene glycol monoethyl ether, propylene carbonate, cyclohexanol, chloroform, trichloroethylene, 1,4-dioxane, ethyl acetate, ethylene glycol monobutyl ether, chlorobenzene, nitroethane, ethylene glycol monomethyl ether, butyl acetate, 1-butanol, methyl isobutyl ketone, nitromethane, toluene, ethanol, diethylene glycol, benzene, diethyl ether, ethanolamine, carbon tetrachloride, propylene glycol, hexane, ethylene glycol, and formamide. A solvent can also be a mixture of several organic solvents or a mixture of water and one or more water soluble or water miscible organic components, such as ethylene glycol, propylene glycol, diethylene glycol, glycerine, dipropylene glycol, polyethylene glycol, polypropylene glycol, amides, ethers, urea, substituted ureas, carboxylic acids and their salts, esters, alcohols, organosulfides, organosulfoxides, sulfones (such as sulfolane), alcohol derivatives, carbitol, butyl carbitol, cellosolve, tripropylene glycol monomethyl ether, ether derivatives, amino alcohols, ketones, N-methylpyrrolidinone, 2-pyrrolidinone, cyclohexylpyrrolidone, hydroxyethers, sulfoxides, lactones, polyelectrolytes, methyl sulfonylethanol, imidazole, betaine, and other water soluble or water miscible materials, as well as mixtures thereof.

A "binder polymer" refers to a crosslinkable polymer that can be crosslinked by a crosslinker or upon initiation by a chemical or physical means (e.g., moisture, heating, UV irradiation or the like) to trap or bind colorants onto or into for example a contact lens forming material. Preferably the binder polymer is soluble in a solvent or a mixture of solvents used in said ink formulation.

Preferably said ink jet inks are stable for at least 4 hours, more preferably at least eight hours, most preferably the ink is stable for at least 24 hours. "Stable" in reference to an ink jet ink, as used herein, means that no liquid phase separation and/or pigment precipitation and/or increase of viscosity occurs over a specific time period.

DETAILED DESCRIPTION OF EMBODIMENTS

Figure 2:
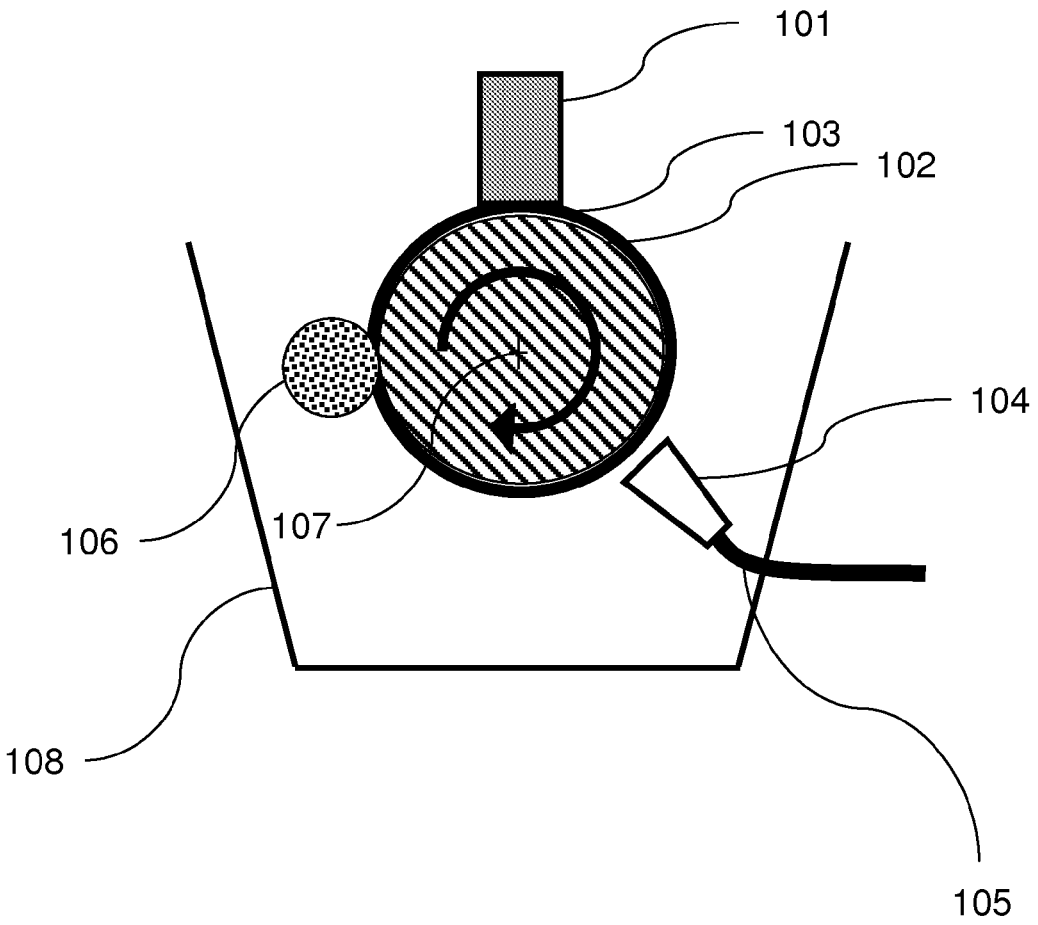
FIG. 2 is a schematic representation of an embodiment of a maintenance unit according to the present invention with print head in cleaning position.

FIGS. 1 and 2 are schematic representations of an embodiment of a maintenance unit for one or more print heads 101 for depositing printing fluid onto a substrate, wherein the maintenance unit comprises a drum 102 with a covering 103 thereon; a nozzle 104 supplied by a pipe 105, which is so arranged that is provides a cleaning liquid to the covering; and a roller 106, which is so arranged that is presses against the covering on the drum to wring excessive cleaning liquid out of the covering.

In FIG. 1, the one or more print heads 101 are at distance to the maintenance unit, e.g. in a printing position or elsewhere, whereas in FIG. 2 the one or more print heads 101 are in contact with the covering 103 on the drum 102, i.e. in a cleaning position. In said cleaning position, the one or more print heads 101 are so arranged, that the (or each) print head plate is fully contacting the covering 103.

The individual components of the maintenance unit in FIGS. 1 and 2 are so arranged, that in the direction of movement of the drum 102, the roller 106 is arranged between the nozzle 104 and the one or more print heads 101. The roller 106 is so arranged, that it presses against the covering 103 on the drum 102 at a position which is in the lower half of the drum, i.e. the axis of the roller is at maximum at the same level or below the axis 107 of the drum (the axis 107 in FIGS. 1 and 2 is indicated with a "+"), as to allow cleaning liquid wrung out of the covering through the roller 106 to drip off the covering and/or the roller into the trough 108. The nozzle 104 is so arranged, that it jets cleaning liquid onto the covering 103 on the drum 102 at a position which is in the lower half of the drum, i.e. the jet of cleaning liquid is hitting the covering at maximum at the same level or below the axis of the drum, as to allow excessive cleaning liquid, which is not held back by the covering to drip off the covering into the trough 108. As shown in FIGS. 1 and 2, the maintenance unit is further comprising a trough 108, which is so arranged that cleaning liquid provided through the nozzle, which is not held back by the covering, as well as cleaning liquid wrung out of the covering through the roller 106, is dripping off the covering and/or the roller into the trough 108.

In the above embodiment, the drum 102 preferably is actively rotated at a speed of from 60 to 120 rpm. The roller 106 preferably is in contact with the covering 103 on the drum 102, and is passively rotating at the same speed accordingly, i.e. driven by the friction between the covering 103 and the roller pressing against the covering 103. The limits for the speed of rotation are dependent on the liquid retention capacity of the covering, on the amount of cleaning liquid provided, and on the "adhesion" of the cleaning liquid to the roller. The more liquid is provided to the covering and the more liquid the covering can retain, the more excessive liquid the roller has to wring out of the covering again. To allow proper wringing of the covering it is required that the excessive liquid can drip off the covering and/or the roller. If the amount of excessive liquid is to high and/or the adherence of the liquid to the roller is to high, the roller will, through its rotation, transport liquid along its surface back to the covering, which has to be avoided. Otherwise the covering, which has been wrung out by the roller to be damp in the first place, will be re-wetted before the covering is wiping the printing head. Said effect can be avoided firstly by careful selection of the roller material (i.e. allowing only little liquid to adhere to the roller surface), and secondly by the dimension of the roller (i.e. a larger diameter of the roller, which allows for a longer dripping off period at the same speed of rotation). A person skilled in the art will know how to optimize these two parameters.

A further embodiment is conceivable which comprises more than one (e.g. two) rollers in a row, i.e. along the direction of rotation of the drum. In said embodiment a first roller would be pressing (with a lower force) only a first amount of liquid from the covering and a second roller would be pressing (with a higher force) the remaining amount of liquid from the covering to finally reach the desired dampness.

A further embodiment is conceivable which comprises more than one (e.g. two) liquid nozzles in a row, i.e. along the direction of rotation of the drum. In said embodiment a first nozzle would be providing a first amount of liquid to the covering and a second nozzle would be providing a second amount of liquid to the covering.

In one embodiment of the invention the drum 102 has a length of from 20 to 200 mm, preferably from 50 to 150 mm, most preferably 140 mm, and a diameter of from 20 to 100 mm, preferably from 40 to 80 mm, most preferably 64 mm. The rotation speed preferably is from 60 to 120 rpm, which corresponds to a rotation speed of from 0.19 to 0.38 m/s at a diameter of 64 mm.

In one embodiment of the invention the covering 103 is a suture-less, lint-free material, preferably a close-mesh woven, synthetic tissue with a thickness of from 1 to 3 mm, most preferably about 2 mm, which is affixed to the surface of the drum 102.

In another embodiment of the invention the covering 103 is a suture-less, lint-free material, preferably a foam with a thickness of from 3 to 6 mm, most preferably about 5 mm, which is affixed to the surface of the drum 102. The foam preferably is an open cell polyurethane (PUR) foam with a bulk density of about 60.

When the print head is in contact with the covering 103 in the cleaning position, it is desirable that the nozzle plate of the print head 101 does not cave into the covering 103 more than the roller 106 is pressing into the covering 103, preferably not more than 1 mm, if a close-mesh woven, synthetic tissue is used, and not more than 2.5 mm if a foam is used.

In one embodiment of the invention, the roller 106 has a length of from 20 to 200 mm, preferably from 50 to 150 mm, most preferably 140 mm, and a diameter of from 10 to 50 mm, preferably from 20 to 40 mm, most preferably 25 mm. The roller 106 is preferably passively rotating with the drum 102. The distance between the surfaces of the drum 102 and the roller 106 preferably is from 0.5 to 5 mm, more preferably from 1 to 2 mm, to allow the cleaning liquid to be wrung out of the covering. In a more preferred embodiment the distance between the surfaces of the drum 102 and the roller 106 is corresponding to the depth the nozzle plate of the print head 101 is caving into the covering 103, i.e. not more than 1 mm, if a close-mesh woven, synthetic tissue is used, and not more than 2.5 mm if a foam is used. Most preferably, the roller is compressing the covering a little more than the nozzle plate of the print head is caving into the covering.

A preferred threshold for a dry covering in an embodiment of the invention comprising a foam, e.g. an open cell polyurethane (PUR) foam with a bulk density of about 60, is that it does contain less than 150 $\mu l/cm^3$ of cleaning liquid, for example about 115 $\mu l/cm^3$. A preferred threshold for a damp covering in an embodiment of the invention comprising a foam, e.g. an open cell polyurethane (PUR) foam with a bulk density of about 60, is from 150 to 210 $\mu l/cm^3$, preferably from 160 to 200 $\mu l/cm^3$, and most preferably about 180 $\mu l/cm^3$. A preferred threshold for a wet covering in an embodiment of the invention comprising a foam, e.g. an open cell polyurethane (PUR) foam with a bulk density of about 60, is that it does contain more than 210 $\mu l/cm^3$, for example about 260 $\mu l/cm^3$.

In the above embodiments, the nozzle 104 preferably is a 90° flat fan nozzle, which is suitable to discharge cleaning liquid to the surface of the drum. The distance between the nozzle 104 an the drum 102 in a preferred embodiment of the invention is about 70 mm for a drum with a length of 140 mm, to cover the whole length of the drum with cleaning liquid. The pressure applied to the nozzle preferably is from 1 to 2 bar.

Figure 3:
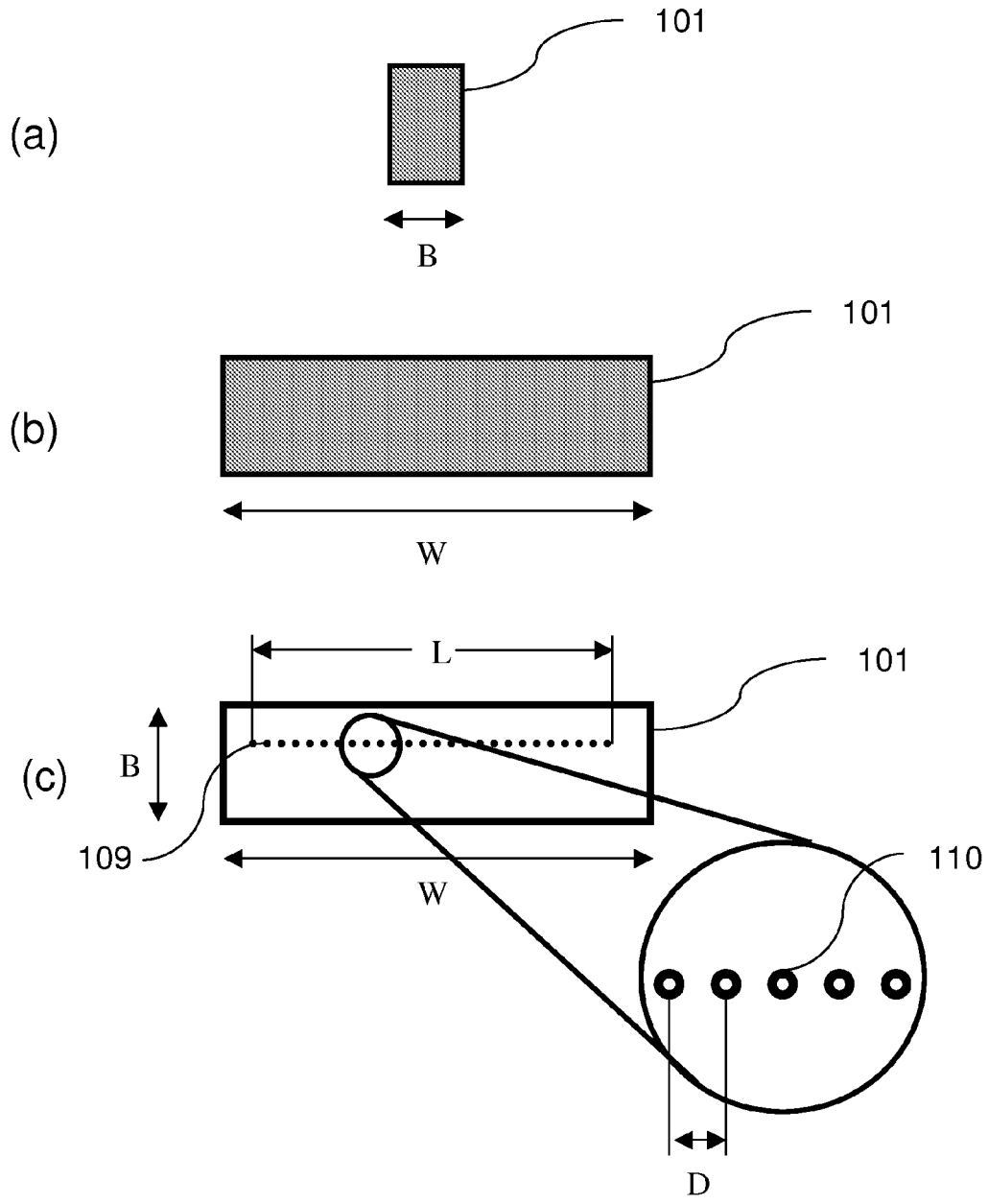
FIG. 3 is showing an ink jet print head in side view (a), front view (b) and bottom view (c), as well as a detail enlargement of the nozzle line of said ink jet print head.

In FIG. 3 (*a*) a print head 101 is shown in side view, wherein B is the depth of the print plate surface, which in one embodiment for example may be 28 mm. In FIG. 3 (*b*) a print head 101 is shown in front view, wherein W is the width of the print plate surface, which in one embodiment for example may be 102 mm. In FIG. 3 (*c*) a print head 101 is shown in bottom view, wherein L is the length of the nozzle line 109, which in one embodiment for example may be 71 mm. In the detail enlargement of FIG. 3(*c*), five nozzles 110 are shown, wherein D is the distance between two nozzles, which in one embodiment for example may be 279 μm. In said embodiment the nozzle line 109 comprises 256 nozzles 110, each with a diameter of 50 μm.

The print head 101 can be approached to the drum either horizontally or vertically. Preferably the print head 101 is approached to the drum horizontally which provides for an additional cleaning effect for the nozzle plate of the print head, as the movement of the print head is wiping the nozzle plate on the covering. For approaching the print head horizontally it is required, that the side walls of the trough 108 are lower than the upper most part of the drum 102 which (with the covering 103 thereon) is contacting the print head 101 in the cleaning position (FIG. 2). Preferably, the drum surface is contacting the print head at level with the maximum height of the side walls of the trough 108, i.e. the covering on the drum is exposed above the level of the side walls of the trough 108.

In one aspect the present invention relates to a maintenance unit for one or more print heads 101, wherein the maintenance unit comprises a drum 102 with a covering 103 thereon; a nozzle 104 supplied by a pipe 105 which is so arranged that is provides a cleaning liquid to the covering; a roller 106 which is so arranged that it presses against the covering 103 on the drum 102 to wring excessive cleaning liquid out of the covering 103; wherein the individual components are so arranged, that in the direction of movement of the drum, the roller 106 is arranged between the nozzle 104 and the one or more print heads 101.

Preferably in the above maintenance unit, the roller 106 is so arranged, that it presses against the covering 103 on the drum 102 at a position which is in the lower half of the drum.

Preferably in the above maintenance unit, the nozzle 104 is so arranged, that it jets cleaning liquid onto the covering 103 on the drum 102 at a position which is in the lower half of the drum.

Preferably in the above maintenance unit, the roller 106 is so arranged that it is pressing against the covering 103 with a force sufficient to wring excessive cleaning liquid out of the covering, such that upon pressing the covering against the one or more print heads 101 no droplets of cleaning liquid are formed on the surface plate of the one or more print heads and/or no cleaning liquid is pressed in the cavities of the one or more print heads.

Preferably in the above maintenance unit, the cleaning liquid provided through the nozzle 104 is water. Preferably in the above maintenance unit, the drum 102 and/or the roller 106 are made of metal or plastic material. Preferably in the above maintenance unit, the covering 103 is made of a suture-less, lint free material selected from the group consisting of close-mesh woven synthetic tissue and foam.

Preferably in the above maintenance unit, the distance between the surfaces of the drum 102 and the roller 106 is corresponding to the depth the print head 101 is caving into the covering 103.

Preferably in the above maintenance unit, the covering 103 is a suture less, lint free foam, and, in operation of the maintenance unit, the covering behind the roller 106 is a damp covering containing from 150 to 210 $\mu l/cm^3$ of cleaning liquid.

In another aspect of the invention relates to a method for cleaning one or more print heads 101 from adhering ink, in particular adhering ink which is fully or partly cured and/or fully or partly dried, wherein the method comprises the steps of (a) wetting a covering 103 on a drum 102 with a cleaning liquid;

(b) wringing excessive cleaning liquid out of the covering 103 to render the covering damp; and (c) wiping the surface plate of the one or more print heads 101 with the damp covering 103 on the drum 102 to remove adhering ink which is fully or partly cured and/or fully or partly dried.

Preferably in the above method in step (c) of wiping the surface plate of the one or more print heads 101 comprises pressing the one or more print heads 101 against the damp covering 103 on the drum 102.

Preferably in the above method in step (b) of wringing excessive cleaning liquid out of the covering 103 comprises pressing a roller 106 against the covering 103 on the drum 102 at a position which is in the lower half of the drum.

Preferably in the above method in step (a) of wetting the covering 103 on the drum 102 with a cleaning liquid comprises supplying cleaning liquid through a nozzle 104 to the covering 103 at a position which is in the lower half of the drum.

Preferably in the above method the drum 102 is rotated at a speed of from 60 to 120 rpm, and the roller 106 is passively rotated accordingly.

In yet another aspect the invention relates to the use of a maintenance unit as described above and/or to a method as described above for cleaning one or more print heads 101 from adhering ink which is fully or partly cured and/or fully or partly dried, in the automated manufacture of a contact lens, in particular a silicone hydrogel contact lens.

The invention claimed is:

1. A maintenance unit for one or more print heads (101), wherein the maintenance unit comprises:

a drum with a covering thereon;

a nozzle supplied by a pipe which is so arranged that the nozzle jets cleaning liquid onto the covering on the drum at a position which is in the lower half of the drum and the nozzle provides a cleaning liquid to the covering;

a roller which is so arranged that it presses against the covering on the drum to wring excessive cleaning liquid out of the covering;

wherein the nozzle and the roller are so arranged, that in the direction of movement of the drum, the roller is arranged between the nozzle and the one or more print heads.

2. Maintenance unit according to claim 1, wherein the roller is so arranged, that it presses against the covering on the drum at a position which is in the lower half of the drum.

3. Maintenance unit according to claim 1, wherein the roller is so arranged that it is pressing against the covering with a force sufficient to wring excessive cleaning liquid out of the covering, such that upon pressing the covering against the one or more print heads no droplets of cleaning liquid are formed on the surface plate of the one or more print heads and/or no cleaning liquid is pressed in the cavities of the one or more print heads.

4. Maintenance unit according to claim 1, wherein the roller is so arranged that it is pressing against the covering with a force sufficient to wring excessive cleaning liquid out of the covering, such that upon pressing the covering against the one or more print heads no droplets of cleaning liquid are formed on the surface plate of the one or more print heads and/or no cleaning liquid is pressed in the cavities of the one or more print heads.

5. Maintenance unit according to claim 1, wherein the roller is so arranged that it is pressing against the covering with a force sufficient to wring excessive cleaning liquid out of the covering, such that upon pressing the covering against the one or more print heads no droplets of cleaning liquid are formed on the surface plate of the one or more print heads and/or no cleaning liquid is pressed in the cavities of the one or more print heads.

6. Maintenance unit according to claim 1, wherein the cleaning liquid provided through the nozzle is water.

7. Maintenance unit according to claim 1, wherein the drum and/or the roller are made of metal or plastic material.

8. Maintenance unit according to claim 1, wherein the covering is made of a suture-less, lint free material selected from a group consisting of close-mesh woven synthetic tissue and foam.

9. Maintenance unit according to claim 1, wherein the covering is made of a suture-less, lint free material selected from a group consisting of close-mesh woven synthetic tissue and foam.

10. Maintenance unit according to claim 1, wherein the distance between the surfaces of the drum and the roller is corresponding to the depth the print head is caving into the covering.

11. Maintenance unit according to claim 1, wherein the covering is a suture-less, lint free foam, and wherein, in operation of the maintenance unit, the covering behind the roller is a damp covering containing from 150 to 210 $\mu l/cm^3$ of cleaning liquid.

12. Maintenance unit according to claim 2, wherein the roller is so arranged that it is pressing against the covering with a force sufficient to wring excessive cleaning liquid out of the covering, such that upon pressing the covering against the one or more print heads no droplets of cleaning liquid are formed on the surface plate of the one or more print heads and/or no cleaning liquid is pressed in the cavities of the one or more print heads.

13. Maintenance unit according to claim 2, wherein the covering is made of a suture-less, lint free material selected from a group consisting of close-mesh woven synthetic tissue and foam.

* * * * *